United States Patent [19]

Combs

[11] 4,272,335

[45] Jun. 9, 1981

[54] COMPOSITION AND METHOD FOR ELECTRODEPOSITION OF COPPER

[75] Inventor: Daniel J. Combs, Sterling Heights, Mich.

[73] Assignee: Oxy Metal Industries Corporation, Warren, Mich.

[21] Appl. No.: 122,204

[22] Filed: Feb. 19, 1980

[51] Int. Cl.[3] ..... C25D 3/38

[52] U.S. Cl. ..... 204/52 R; 260/245.1

[58] Field of Search ..... 204/52 R, 44, 106; 106/1.26; 260/245.1

[56] References Cited

U.S. PATENT DOCUMENTS

| | | | |
|---|---|---|---|
| 2,197,860 | 4/1940 | Gassner et al. | 260/245.1 |
| 3,484,450 | 12/1969 | Schundehutte et al. | 260/245.1 |
| 4,039,346 | 8/1977 | Kranz | 260/245.1 X |

*Primary Examiner*—G. L. Kaplan

*Attorney, Agent, or Firm*—Richard P. Mueller

[57] ABSTRACT

A composition and method for electrodepositing ductile, bright, level copper deposits from an aqueous acidic copper plating bath having dissolved therein a brightening amount of a compound comprising a substituted phthalocyanine radical. In accordance with a preferred embodiment, the composition and method further includes in the copper plating bath secondary brightening agents including aliphatic polysulfides and/or organic sulfides and/or polyethers, as well as other known additives for acid copper plating baths.

12 Claims, No Drawings

COMPOSITION AND METHOD FOR ELECTRODEPOSITION OF COPPER

BACKGROUND OF THE INVENTION

This invention broadly relates to a composition and process for the electrodeposition of copper, and more particularly, to a composition and method for the electrodeposition of copper from aqueous acidic copper plating baths, especially from copper sulfate and fluoroborate baths. More specifically, the invention relates to the use of a novel brightening agent, preferably in conjunction with supplemental brightening agents to produce bright, ductile, level copper deposits with good recess brightness on metal substrates over a wide range of bath concentrations and operating current densities.

A variety of compositions and methods have heretofore been used or proposed for use incorporating various additive agents for electrodepositing bright, level, ductile copper deposits from aqueous acidic copper electroplating baths. Typical of such prior art processes and compositions are those described in U.S. Pat. Nos. 3,267,010; 3,328,273; 3,770,598 and 4,110,176 which are assigned to the same assignee as the present invention. According to the teachings of U.S. Pat. No. 3,267,010, it has been found that bright, level and ductile deposits of copper can be produced from an aqueous acidic copper electroplating bath incorporating therein a bath-soluble polymer of 1,3-dioxolane, preferably in conjunction with supplemental brightening agents including organic sulfide compounds; U.S. Pat. No. 3,328,273 teaches the use of a bath-soluble polyether compound containing at least 6 carbon atoms as a brightening agent, preferably in conjunction with aliphatic polysulfide compounds; U.S. Pat. No. 3,770,598 teaches the use of a bath-soluble reaction product of polyethyleneimine and an alkylating agent to produce a quaternary nitrogen as a brightener, preferably in conjunction with aliphatic polysulfides, organic sulfides and/or polyether compounds; while U.S. Pat. No. 4,110,176 teaches the use of a bath-soluble poly (alkanol quaternary ammonium salt) as a brightening agent such as produced from the reaction of a polyalkylenimine with an alkylene oxide.

While the compositions and methods described in the aforementioned United States patents provide for excellent bright, ductile, and level copper deposits, the bath composition and process of the present invention provide for still further improvements in many instances in the ductility, leveling and brightness of the copper deposit particularly in recess areas.

SUMMARY OF THE INVENTION

The benefits and advantages of the present invention are achieved by a composition and method for the electrodeposition of copper from aqueous acidic plating baths containing a brightening amount of a compound comprising a bath soluble substituted phthalocyanine radical. More particularly, the aqueous acidic bath is of the copper sulfate and fluoroborate type and incorporates a substituted phthalocyanine radical of the structural formula:

$$Pc-(X)_n$$

Wherein:

Pc is a phthalocyanine radical;

X is $-SO_2NR_2$, $-SO_3M$, $-CH_2SC(NR_2)_2{}^+Y^-$;

R is H, alkyl containing 1-6 carbon atoms, aryl containing 6 carbon atoms, aralkyl containing 6 carbon atoms in the aryl portion and 1 to 6 carbon atoms in the alkyl portion, heterocyclic containing 2 to 5 carbon atoms and at least 1 nitrogen, oxygen, sulfur or phosphorus atom, and alkyl, aryl, aralkyl and heterocyclic, as defined above, containing 1 to 5 amino, hydroxy, sulfonic or phosphonic groups;

n is 1-6;

Y is halogen or alkyl sulfate containing 1 to 4 carbon atoms in the alkyl portion; and M is H, Li, Na, K or Mg.

Compounds of the foregoing structural formula have a bath solubility of at least about 0.1 milligrams per liter (mg/l).

The characteristics of the electrodeposited copper in accordance with the composition and method aspects of the present invention are further enhanced in accordance with a preferred practice in which secondary brightening agents including aliphatic polysulfides, organic sulfides and/or polyether compounds are employed in conjunction with the substituted phthalocyanine radical primary brightening agent. The phthalocyanine brightening agent may be metal-free or may contain a stable divalent or trivalent metal, such as cobalt, nickel, chromium, iron, or copper, as well as mixtures of these, of which copper constitutes the preferred metal.

In accordance with the method aspects of the present invention, the aqueous acidic electroplating bath can be operated at temperatures ranging from about 15 up to about 50 degrees C. and current densities ranging from about 0.5 to about 400 amperes per square foot (ASF).

Additional benefits and advantages of the present invention will become apparent upon a reading of the description of the preferred embodiments taken in conjunction with the accompanying examples.

DESCRIPTION OF THE PREFERRED EMBODIMENTS

In accordance with the composition and method aspects of the present invention, aqueous acidic copper plating baths are employed which are either of the acidic copper sulfate or acidic copper fluoroborate type. In accordance with conventional practice, aqueous acidic copper sulfate baths typically contain from about 180 to about 250 grams per liter (g/l) of copper sulfate and about 30 to about 80 g/l of sulfuric acid. Acidic copper fluoroborate baths in accordance with prior art practice typically contain from about 150 to about 600 g/l copper fluoroborate and up to about 60 g/l of fluoroboric acid. It has been found that aqueous acidic plating baths of the foregoing types incorporating the brightening agents of the present invention can be operated under conditions of high acid and low copper content. Accordingly, even when such baths contain as little as about 7.5 g/l copper and as much as 350 g/l sulfuric acid or 350 g/l of fluoroboric acid, excellent plating results are still obtained.

In accordance with the method aspects of the present invention, the acidic copper plating baths of the present invention are typically operated at current densities ranging from about 10 to about 100 ASF although current densities as low as about 0.5 ASF to as high as about 400 ASF can be employed under appropriate conditions. Preferably, current densities of about 10 to about 50 ASF are employed. In plating conditions in which high agitation is present, higher current densities ranging up to about 400 ASF can be employed and for this purpose air agitation, cathode-rod agitation and/or solution agitation may be employed.

The operating temperature of the plating baths may range from about 15 degrees C. to as high as about 50 degrees C., with temperatures of about 21 degrees C. to about 36 degrees C. being typical.

The aqueous acidic bath also desirably contains halide ions such as chloride and/or bromide anions, which are typically present in amounts not in excess of about 0.5 g/l.

In addition to the foregoing, the acid copper plating bath of the present invention contains, as a novel brightening agent, a brightening amount of a bath soluble compound comprising a substituted phthalocyanine radical which may be metal-free or which may contain a stable divalent or trivalent metal bound by coordination of the isoindole nitrogen atoms of the molecule, which metal is selected from the group consisting of cobalt, nickel, chromium, iron or copper, as well as mixtures of these, of which copper is the more typical and preferred metal. In this latter regard, it is intended to mean that the novel brightening agent may be made up of a mixture of substituted phthalocyanine compounds which contain the same or different metals from the group.

The substituted phthalocyanine compound which can be satisfactorily employed in the practice of the present invention is one having a bath solubility of at least about 0.1 milligram per liter (mg/l) which corresponds to the structural formula:

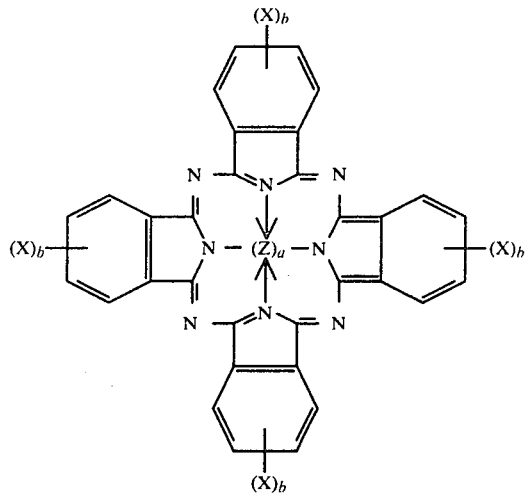

Wherein:

X is as been heretofor defined;

Z is Ni, Co, Cr, Fe or Cu;

a is 0–1; and b is 0–2, provided however that the total number of X substituents is 1–6

Phthalocyanine compounds in accordance with the foregoing structural formula and their methods of preparation are well known in the art. Exemplary of these is the review in Rodds Chemical Carbon Compounds, 2nd Edition 1977, Vol. 4B, pages 334–339 and under Colour Index Number 74280 by the Society of Dyers and Colourers, England and the references cited therein.

A specifically preferred phthalocyanine compound which falls with the foregoing is Alcian Blue which has the following structural formula:

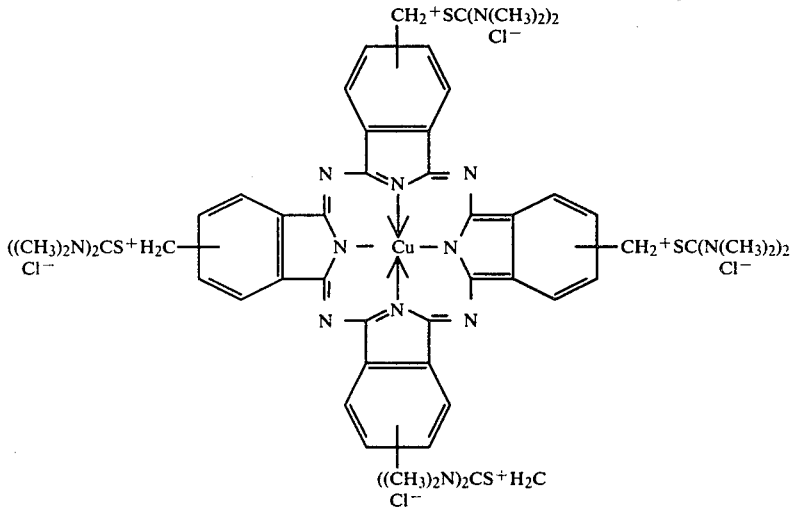

Typically, Alcian Blue may be prepared by reacting copper phthalocyanine with formaldehyde in the presence of $AlCl_3$ and HCl and then reacting the resulting product with N-tetramethylthiourea to form the Alcian Blue.

The phthalocyanine brightening agent is employed in the acidic copper plating bath in a brightening amount which may be as low as about 0.1 mg/l to concentrations as high as about 10 g/l, with amounts ranging from about 2 to about 60 mg/l being preferred for most plating situations. The incorporation of the phthalocyanine brightening agent provides for improved leveling and brightness of the electrodeposited copper particularly in recess areas of parts being electroplated.

In addition to the phthalocyanine brightening agent, it has been found advantageous in accordance with the practice of the present invention to incorporate at least one additional supplemental brightening agent of the types known in the art to further enhance the brightness, ductility and leveling of the electrodeposited copper. Included among such supplemental bath additives are various bath soluble polyether compounds. The most preferred polyethers are those containing at least six ether oxygen atoms and having a molecular weight of from about 150 to 1 million. Of the various polyether compounds which may be used, excellent results have been obtained with the polypropylene polyethylene and glycols including mixtures of these, of average molecular weight of from about 600 to 4,000, and alkoxylated aromatic alcohols having a molecular weight of about 300 to 2500. Exemplary of the various preferred polyether compounds which may be used are those set forth hereinafter in Table I. Desirably, the plating baths of the present invention contain these polyether compounds in amounts within the range of about 0.001 to 5 grams per liter, with the lower concentrations generally being used with the higher molecular weight polyethers.

groups may also contain various substituting groups, such as methyl, chloro, bromo, methoxy, ethoxy, carboxy or hydroxy, on the molecules, especially on the aromatic and heterocyclic sulfide-sulfonic or phosphonic acids. These organic sulfide compounds may be used as the free acids, the alkali metal salts, organic amine salts, or the like. Exemplary of specific sulfonate organic sulfides which may be used are those set forth in Table I of U.S. Pat. No. 3,267,010, and Table III of U.S. Pat. No. 4,181,582, as well as the phosphonic acid derivatives of these. Other suitable organic divalent sulfur compounds which may be used include $HO_3P—(CH_2)_3—S—S—(CH_2)_3—PO_3H$, as well as mercaptans, thiocarbamates, thiolcarbamates, thioxanthates, and thiocarbonates which contain at least one sulfonic or phosphonic group.

A particularly preferred group of organic divalent sulfur compounds are the organic polysulfide compounds. Such polysulfide compounds may have the formula $XR_1—(S)_nR_2SO_3H$ or $XR_1—(S)_nR_2PO_3H$ wherein $R_1$ and $R_2$ are the same or different alkylene group containing from about 1 to 6 carbon atoms, X is hydrogen $SO_3H$ or $PO_3H$ and n is a number from about 2 to 5. These organic divalent sulfur compounds are aliphatic polysulfides wherein at least two divalent sulfur atoms are vicinal and wherein the molecule has one or two terminal sulfonic or phosphonic acid groups. The alkylene portion of the molecule may be substituted

TABLE I

| POLYETHERS | | |
|---|---|---|
| 1. | Polyethylene glycols | (Ave. M.W. of 400-1,000,000) |
| 2. | Ethoxylated naphthols | (Containing 5-45 moles ethylene oxide groups) |
| 3. | Propoxylated napthols | (Containing 5-25 moles of propylene oxide groups) |
| 4. | Ethoxylated nonyl phenol | (Containing 5-30 moles of ethylene oxide groups) |
| 5. | Polypropylene glycols | (Ave. M.W. of 350-1,000) |
| 6. | Block polymers of polyoxyethylene and polyoxypropylene glycols | (Ave. M.W. of 350-250,000) |
| 7. | Ethoxylated phenols | (Containing 5-100 moles of ethylene oxide groups) |
| 8. | Propoxylated phenols | (Containing 5-25 moles of propylene oxide groups) |
| 9. | $HO(C_2H_4O)_{5-100}C_2H_4O—C(CH_3)_2—C≡C—C(CH_3)_2—C—OC_2H_4(OC_2H_4)_{5-100}OH$ | |
| 10. | $HO(C_2H_4O)_{5-100}C_2H_4O—C(CH_3)(C_2H_5)—C≡C—C(CH_3)(C_2H_5)—OC_2H_4(OC_2H_4)_{5-100}OH$ | |
| 11. | 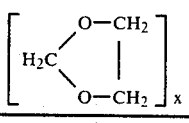 | Where X = 4 to 375 and the Ave. M.W. is 320-30,000 |

A particularly desirable and advantageous supplemental additive comprises organic divalent sulfur compounds including sulfonated or phosphonated organic sulfides, i.e,, organic sulfide compounds carrying at least one sulfonic or phosphonic group. These organic sulfide compounds containing sulfonic or phosphonic with groups such as methyl, ethyl, chloro, bromo, ethoxy, hydroxy, and the like. These compounds may be added as the free acids or as the alkali metal or amine salts. Exemplary of specific organic polysulfide compounds which may be used are set forth in Table I of column 2 of U.S. Pat. No. 3,328,273 and the phosphonic acid derivatives of these.

Desirably, these organic sulfide compounds are present in the plating baths of the present invention in amounts within the range of about 0.0005 to 1.0 grams per liter.

It is to be appreciated that the supplemental brighteners described above are merely exemplary of those which may be used with the phthalocyanine brightening agents of the present invention and that other secondary or supplemental brighteners for acid copper plating baths, as are known in the art, including dyes such as Janus Green, may also be used.

In order to further illustrate the improved aqueous acidic copper bath composition and method of the present inventions, the following examples are provided. It will be understood that the examples are provided for illustrative purposes and are not intended to be limiting of the scope of the present invention as herein described and as set forth in the subjoined claims.

Standard aqueous acid copper sulfate solutions, as follows, were prepared containing the components listed in the concentrations indicated:

Standard Solution A

| Components | Concentrations |
|---|---|
| $CuSO_4 \cdot 5H_2O$ | 225 grams/liter |
| $H_2SO_4$ | 67.5 grams/liter |
| $Cl^-$ | 35 mg/l |

The chloride ion was introduced as hydrochloric acid.

Standard Solution B

| Components | Concentration |
|---|---|
| $CuSO_4 \cdot 5H_2O$ | 225 grams/liter |
| $H_2SO_4$ | 90 grams/liter |
| $Cl^{31}$ | 100 mg/l |

The chloride ion was introduced as hydrochloric acid.

The phthalocyanine brightening agents designated as Alcian Blue and Alcian Green, as employed in the following Examples correspond to dyes found under Colour Index number 74280 by Society of Dyers and Colourers, England.

EXAMPLE 1

A plating solution was prepared by adding to one liter of Standard Solution A the following:

| Additive | Concentration |
|---|---|
| Phthalocyanine Compound (Alican Blue) | 0.020 g/l |
| Polyethylene glycol (M.W. about 4,000) | 0.008 g/l |
| $HO_3S—(CH_2)_3—S—S—(CH_2)_3—SO_3H$ | 0.020 g/l |

A "J" shaped polished steel panel was cleaned and plated with a thin cyanide copper coating. The coated panel was rinsed and then plated in the plating bath for a period of 5 minutes at a current density of 50 ASF using air agitation and at a bath temperature of about 24 degrees C. The resultant plated panel produced a bright copper deposit with good leveling, including a bright recess.

EXAMPLE 2

A plating solution was prepared by adding to one liter of Standard Solution B, the following:

| Additive | Concentration |
|---|---|
| Phthalocyanine Compound (Alcian Green) | 0.030 g/l |
| Polyethylene glycol (M.W. about 6,000) | 0.008 g/l |
| $HO_3P—(CH_2)_3—S—S—(CH_2)_3—PO_3H$ | 0.020 g/l |

"J" shaped polished steel test panels were prepared in accordance with the method as described in Example 1 and were plated with the above plating solution for a period of 10 minutes at a current density of 40 ASF employing air agitation at a bath temperature of about 25 degrees C. Bright, level copper deposits with good leveling and brightness in the recess areas is obtained.

EXAMPLE 3

A plating solution was prepared by adding to one liter of Standard Solution B, the following:

| Additive | Concentration |
|---|---|
| Phthalocyanine Compound (Alcian BLue) | 0.020 g/l |
| Polypropylene Glycol (M.W. 750) | 0.065 g/l |
| $HS—(CH_2)_3—S_3H$ | 0.030 g/l |
| Reaction product of polyethylene imine (M.W. 600) with benzyl chloride (in molar ratios), the imine reactant containing about 25% primary, 50% secondary and 25% tertiary nitrogen | 0.0008 g/l |

A "J" shaped steel test panel was prepared in accordance with Example 1 and was plated for a period of 15 minutes at a current density of from about 20 to about 40 ASF using air agitation at a bath temperature of about 20 degrees C. The test panel exhibited a bright copper deposit with good leveling and good brightness in recess areas.

EXAMPLE 4

A plating solution was prepared by adding to one liter of Standard Solution B, the following:

| Additive | Concentration |
|---|---|
| Phthalocyanine Compound (Alcian Blue) | 0.01 g/l |
| Block polymer of ethylene/propylene oxide (M.W. about 3,000) | 0.0065 g/l |
| $HO_3S—(CH_2)_3—S—S—(CH_2)_3—SO_3H$ | 0.020 g/l |

A "J" shaped test panel was prepared and plated under the same conditions as previously described in connection with Example 3 and similar results were obtained.

EXAMPLE 5

A plating solution was prepared containing the following components in the amounts indicated:

| Component | Concentration |
|---|---|
| Copper fluroborate | 150 grams/liter |
| Fluroboric acid | 30 grams/liter |
| Boric acid | 7.5 grams/liter |
| Phthalocyanine Compound (Alcian Blue) | 0.020 grams/liter |
| Reaction product of 1 mole of B-napthol with 10 moles ethylene oxide | 0.10 grams/liter |
| $HO_3S(CH_2)_3S—S(CH_2)_3SO_3H$ | 0.020 grams/liter |

A "J" shaped test panel was prepared as described in Example 1 and was plated for 15 minutes at a current density of 20–40 ASF with air agitation at a bath temperature of 20 degrees C. The resulting test panel exhibited a bright copper deposit with good leveling and brighteness in recess areas.

EXAMPLE 6

A plating solution was prepared by adding to one liter of Standard Solution B the following:

| Additive | Concentration |
|---|---|
| Phthalocyanine Compound (Alcian Blue) | 0.010 grams/liter |
| Janus Green | 0.010 grams/liter |
| Polyethylene Oxide (M.W. about 4,000) | 0.040 grams/liter |
| $HO_3S(CH_2)_3—S—S—(CH_2)_3SO_3H$ | 0.015 grams/liter |

A "J" shaped test panel was prepared and plated under the same conditions as previously described in connection with Example 5 and similar results were obtained.

EXAMPLE 7

A plating solution was prepared by adding to one liter of Standard Solution B, 0.005 grams/liter of a phthalocyanine compound (Alcian Blue).

A "J" shaped test panel was prepared and plated under the same conditions as previously described in connection with Example 5. A semi-bright deposit was obtained in low current density areas with grain refinement in the higher current density areas. The deposit showed good ductility throughout the entire current density range.

While it will be apparent that the invention herein disclosed is well calculated to achieve the benefits and advantages as hereinabove set forth, it will be appreciated that the invention is susceptible to modification, variation and change without departing from the spirit thereof.

What is claimed is:

1. In a bath for the electrodeposition of copper, which bath comprises an aqueous acidic solution containing copper in an amount sufficient to electroplate copper on a substrate, the improvement which comprises including in said bath a brightening amount sufficient to produce a bright copper electrodeposit, of a compound comprising a substituted phthalocyanine radical.

2. The bath as defined in claim 1 in which said compound corresponds to the structural formula:

$$Pc—(X)_n$$

Wherein:

Pc is a phthalocyanine radical;

X is $—SO_2NR_2$, $—SO_3M$, $—CH_2SC(NR_2)_2{}^+Y^-$;

R is H, alkyl containing 1–6 carbon atoms, aryl containing 6 carbon atoms, aralkyl containing 6 carbon atoms in the aryl portion and 1 to 6 carbon atoms in the alkyl portion, heterocyclic containing 2 to 5 carbon atoms and at least 1 nitrogen, oxygen, sulfur or phosphorus atom, and alkyl, aryl, aralkyl and heterocyclic, as defined above, containing 1 to 5 amino, hyroxy, sulfonic or phosphonic groups;

n is 1–6

Y is halogen or alkyl sulfate containing 1 to 4 carbon atoms in the alkyl portion; and M is H, Li, Na, K or Mg said compound having a bath solubility of at least 0.1 mg/l.

3. The bath as defined in claim 1 in which said phthalocyanine radical as added to the bath is metal-free.

4. The bath as defined in claim 1 in which said phthalocyanine radical is a stable metal-containing phthalocyanine radical.

5. The bath as defined in claim 4 in which said metal-containing phthalocyanine radical contains a divalent or trivalent metal selected from the group consisting of cobalt, nickel, chromium, iron, and copper, as well as mixtures thereof.

6. The bath as defined in claim 4 in which said metal-containing phthalocyanine radical contains copper.

7. The bath as defined in claim 1 in which there is also present a bath soluble polyether compound as a supplemental brightener.

8. The bath as defined in claim 7 in which there is also present a bath soluble organic divalent sulfur compound as an additional supplemental brightener.

9. The bath as defined in claim 8 in which the organic divalent sulfur compound is an organic polysulfide compound.

10. The bath as defined in claim 1 in which there is also present a bath soluble organic divalent sulfur compound as a supplemental brightener.

11. The bath as defined in claim 10 in which the organic divalent sulfur compound is an organic polysulfide compound.

12. A method for depositing a bright copper plating on a substrate which comprises the steps of electrodepositing copper from an aqueous acidic copper electroplating bath of a composition as defined in any one of claims 1 through 11.

* * * * *